United States Patent [19]

Genevey

[11] 4,212,326

[45] Jul. 15, 1980

[54] FLOW RATE LIMITER FOR A HYDRAULIC CIRCUIT

[75] Inventor: Jacques Genevey, Echirolles, France

[73] Assignee: Alsthom-Atlantique, Paris, France

[21] Appl. No.: 32,803

[22] Filed: Apr. 24, 1979

Related U.S. Application Data

[63] Continuation of Ser. No. 865,555, Dec. 29, 1977, abandoned.

[30] Foreign Application Priority Data

Jan. 18, 1977 [FR] France ..... 77 01300

[51] Int. Cl.[2] ..... F15D 1/00

[52] U.S. Cl. ..... 138/40

[58] Field of Search ..... 138/40, 37, 39, 41

[56] References Cited

U.S. PATENT DOCUMENTS

| | | | |
|---|---|---|---|
| 1,539,256 | 5/1925 | Gfeller | 138/40 |
| 1,648,708 | 11/1927 | Wilkinson | 138/40 |
| 2,995,007 | 8/1961 | Rae | 138/40 |
| 3,071,160 | 1/1963 | Weichbrod | 138/40 |

FOREIGN PATENT DOCUMENTS 2161851 7/1973 France .

*Primary Examiner*—Lenard A. Footland

*Attorney, Agent, or Firm*—Sughrue, Rothwell, Mion, Zinn and Macpeak

[57] ABSTRACT

A static limiter of the flow rate through a hydraulic circuit generates a pocket having a high degree of cavitation at a predetermined flow rate. The static limiter constitutes a streamlined, oval body coaxially mounted within a circular cylinder with obstacles fixedly disposed between the streamlined body and the cylinder whose diameter is greater than that of the body. Under certain conditions it can operate as a non-return valve.

6 Claims, 3 Drawing Figures

FLOW RATE LIMITER FOR A HYDRAULIC CIRCUIT

This is a Continuation, of application Ser. No. 865,555, filed Dec. 29, 1977, now abandoned.

FIELD OF THE INVENTION

The invention relates to a flow rate limiter for a hydraulic circuit and, more particularly, to a flow rate limiter of the static type.

BACKGROUND OF THE INVENTION

Flow rate limiters for hydraulic circuits are generally constituted by mechanical shutters whose movement is controlled by a flow rate detector. Now such devices sometimes operate erratically and always require a noticeable response time, which is undesirable for the safety of the installations which they are intended to protect.

For this purpose French Pat. specification No. 2,161,851 (no English language equivalent) describes supercavitation units i.e. having high cavitation, for insertion in hydraulic circuits to limit the flow therethrough. But in most cases the units described do not lend themselves to being inserted in the hydraulic circuit. These units usually require a passage of cross-section which is very much smaller than that of the hydraulic circuit in which the unit is to be inserted, together with a converging portion upstream and a diverging portion downstream. The result is that such a supercavitating unit is very long and is not easily adapted to a hydraulic circuit.

Preferred embodiments of the present invention provide statically operating flow rate limiters for hydraulic circuits which are of small bulk and whose insertion in the hydraulic circuit presents few problems.

The invention provides a flow rate limiter for a hydraulic circuit, comprising means defining a passage whose inside wall is a circular cylinder having an upstream end and a downstream end. A streamlined body is disposed coaxially on the axis of the wall and includes a nose at its upstream end and a tail at its downstream end. Obstacles are disposed in the annular space between the wall and the body, said obstacles causing a supercavitation in the said annular space under the influence of a predetermined flow rate through the passage. Means are provided for fixing the body and the obstacles to the passage defining means.

Preferably the means for fixing the streamlined body are constituted by radial fins supported by the wall.

In that case the obstacles can be supported by a ring disposed in the annular space with the ring fixed to the said radial fins.

In one configuration the obstacles are disposed beside the nose of the streamlined body, the nose itself being disposed at the upstream end of the limiter.

In another configuration the obstacles are disposed beside the tail of the streamlined body, which is itself disposed at the downstream end of the limiter.

An embodiment of the invention is described by way of example with reference to the accompanying drawings.

DESCRIPTION OF THE PREFERRED EMBODIMENTS

Figure 1:
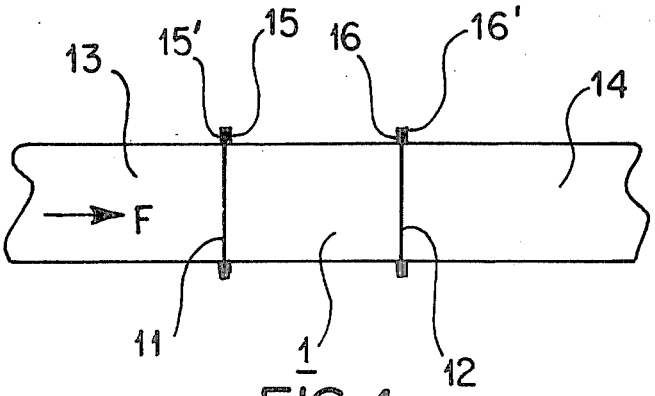
FIG. 1 is a schematic view of a hydraulic installation including a flow rate limiter forming one embodiment of the present invention.
Figure 3:
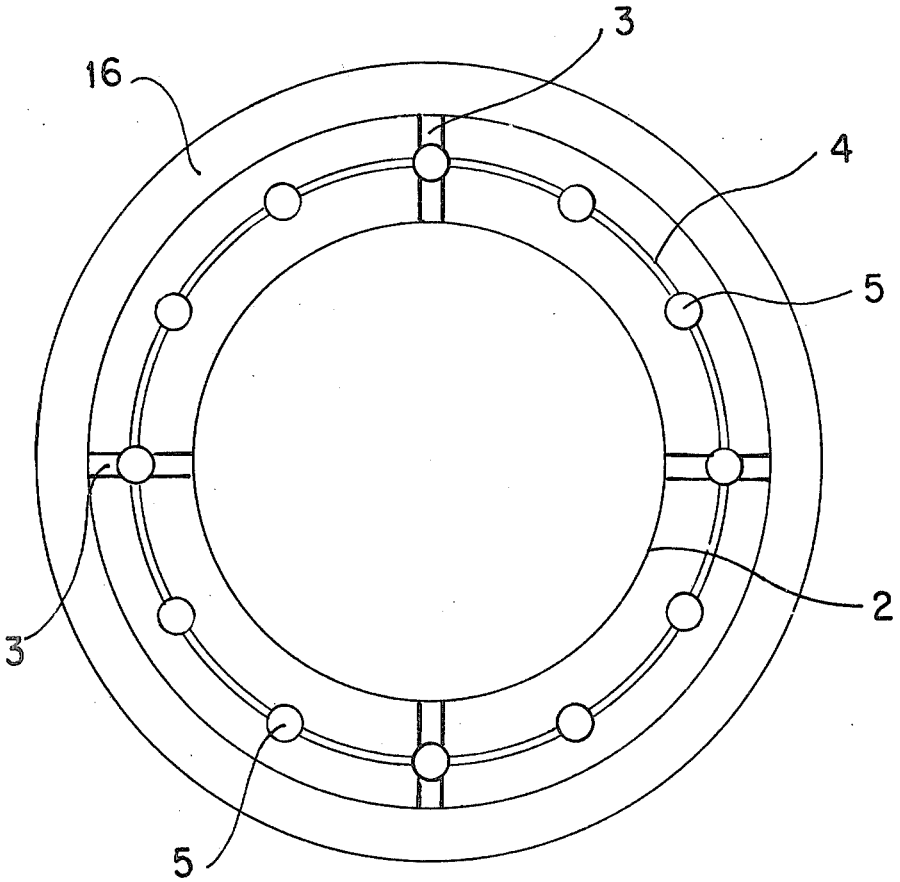
FIG. 3 is an end view of the flow rate limiter.
Figure 2:
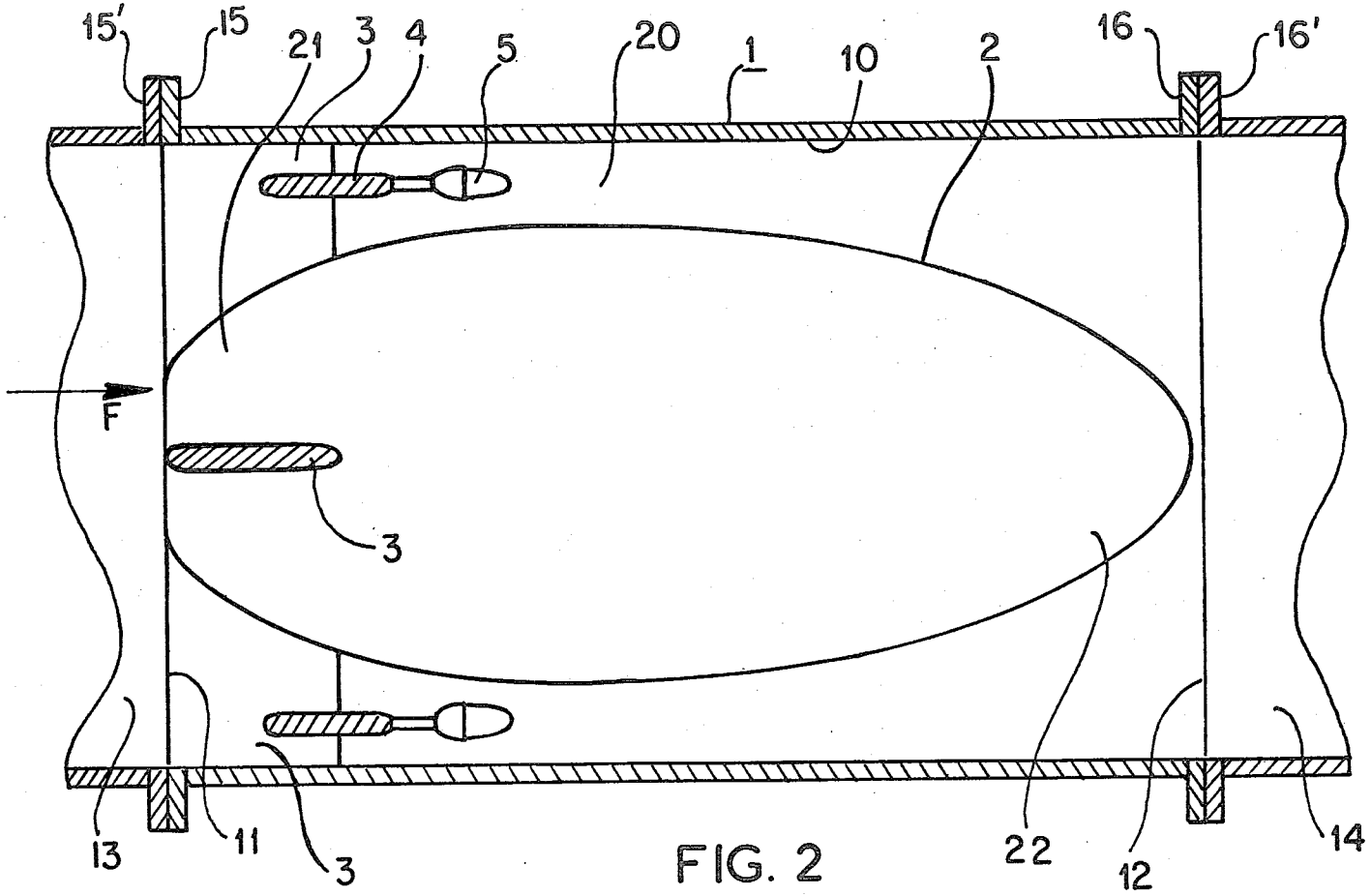
FIG. 2 is a section of a flow rate limiter according to FIG. 1.

In the figures reference 1 designates the flow rate limiter as a whole, which includes an upstream end 11 and a downstream end 12. The flow rate limiter 1 is inserted in a hydraulic circuit installation which comprises an upstream pipe 13 on one side to which it is connected by a flange 15 co-operating with a flange 15' and by a downstream pipe 14 to which it is connected by a flange 16 co-operating with a flange 16'. The upstream pipe is normally at a higher pressure than the downstream pipe, so that the flow takes place in the direction of the arrow F.

The flow rate limiter 1 is constituted by a passage having the same cross-section as the pipes 13 and 14 to which it is connected. It has an inner wall 10 which is a circular cylinder.

A streamlined body 2 of circular section is disposed coaxially inside the wall 10. The body 2 has a nose 21 at its upstream end and a tail 22 at its downstream side, and delimits an annular space 20 between the body 2 and the wall 10.

The body 2 is supported on its upstream end by four radial fins 3 fixed to the wall 10 of the flow rate limiter.

The streamlining of the nose 21 is such that with the flow coming from upstream, it forms in conjunction with the wall 10 an annular converging portion, while the streamlining of the tail 22 forms in conjunction with the wall 10 an annular diverging portion.

The fins 3 support a ring 4 in the upstream annular space concentrically with the streamlined body 2. Obstacles 5, having the shape of acorns and distributed in the annular space 20 are fixed to the ring.

These obstacles are such that in the presence of a predetermined flow rate through the limiter 1, corresponding to the cavitation speed, they cause the downstream flow to separate, forming a pocket of high intensity cavitation in the annular space 20. Once this pocket appears, the flow rate through the installation becomes limited by the presence of the cavitation pocket and the installation including the upstream pipe 13 is itself protected against local cavitation phenonema.

It is clear that the invention is in no way limited to the embodiment which has been described and shown in the drawings, and which was given purely by way of example; in particular, it is possible without leaving the scope of the invention, to modify certain dispositions are to replace certain means by equivalent means or even to replace certain elements by other elements capable of performing the same technical function or a technically equivalent function.

Thus another embodiment not shown, can be provided in which the obstacles are disposed downstream beside the tail, the flow rate limiter could operate as a flow rate limiting non-return valve in the case where, after an accident in use, the flow rate reverses in the installation.

What is claimed is:

1. A flow rate limiter for a hydraulic circuit comprising:

means forming a passage having an inside wall in the form of a circular cylinder having an upstream end and a downstream end;

means disposed within said passage for producing supercavitation of the hydraulic flow through said passage, the improvement comprising:

a streamlined body disposed caoxially on the axis of the wall and including a nose at its upstream end, a diverging surface portion extending downstream therefrom and merging into a converging surface portion and terminating in a tail at its downstream end; and wherein said supercavitation producing means comprises a plurality of circumferentially spaced supercavitation producing obstacles between the wall and the body, with said obstacles causing supercavitation in said annular space under the influence of a predetermined flow through said passage throughout said annular space defined by said streamlined body and said inside wall; and means for fixing the body and said obstacles within said passage.

2. A flow rate limiter according to claim 1, wherein the streamlined body is of circular cross-section.

3. A flow rate limiter according to claim 2, wherein the means for fixing the streamlined body comprise radial fins supported by the wall.

4. A limiter according to claim 3, wherein the obstacles are supported on a ring disposed in the annular space.

5. A limiter according to claim 4, wherein the ring is fixed to the wall by the said radial fins.

6. A limiter according to claim 1, wherein the obstacles are disposed adjacent the nose of the streamlined body, and wherein the nose is itself disposed at the upstream end of the limiter.

* * * * *